US007288879B2

(12) United States Patent
Matsutani et al.

(10) Patent No.: US 7,288,879 B2
(45) Date of Patent: Oct. 30, 2007

(54) SPARK PLUG HAVING GROUND ELECTRODE INCLUDING PRECIOUS METAL ALLOY PORTION CONTAINING FIRST, SECOND AND THIRD COMPONENTS

(75) Inventors: Wataru Matsutani, Nagoya (JP); Osamu Yoshimoto, Nagoya (JP); Yoshihiro Matsubara, Yokkaichi (JP)

(73) Assignee: NGK Spark Plug Co., Ltd., Aichi (JP)

( * ) Notice: Subject to any disclaimer, the term of this patent is extended or adjusted under 35 U.S.C. 154(b) by 345 days.

(21) Appl. No.: 10/951,788

(22) Filed: Sep. 29, 2004

(65) Prior Publication Data

US 2006/0043856 A1 Mar. 2, 2006

Related U.S. Application Data

(60) Provisional application No. 60/606,104, filed on Sep. 1, 2004.

(51) Int. Cl.
*H01T 13/20* (2006.01)
*H01T 13/39* (2006.01)

(52) U.S. Cl. ..... 313/141; 313/142; 313/144

(58) Field of Classification Search ..... 313/141
See application file for complete search history.

(56) References Cited

U.S. PATENT DOCUMENTS 4,670,684 A 6/1987 Kagawa et al.
4,743,793 A 5/1988 Toya et al.
4,786,267 A 11/1988 Toya et al.
6,094,000 A 7/2000 Osamura et al.
6,147,441 A 11/2000 Osamura
6,597,089 B2 7/2003 Matsutani
6,617,706 B2 9/2003 Matsubara et al.
6,720,716 B2 4/2004 Shibata et al.
6,750,598 B2 6/2004 Hori
6,794,803 B2 9/2004 Hori et al.
7,086,363 B2 * 8/2006 Miwa et al. ..... 123/169 EL
2002/0063504 A1 * 5/2002 Hori ..... 313/141
2003/0038576 A1 2/2003 Matsutani et al.
2004/0066125 A1 * 4/2004 Beaudet ..... 313/140
2004/0183418 A1 * 9/2004 Orjela et al. ..... 313/141

(Continued)

FOREIGN PATENT DOCUMENTS

EP 0 243 529 A1 11/1987

(Continued)

*Primary Examiner*—Sikha Roy
(74) *Attorney, Agent, or Firm*—Sughrue Mion, PLLC

(57) ABSTRACT

A spark plug including: a cylindrical metal shell; a cylindrical insulator fixed to the metal shell; a center electrode having its leading end protruding from a leading end of the insulator and its trailing end fixed to the insulator; and a ground electrode having one end fixed to the metal shell and forming a discharge gap between the ground electrode and the center electrode. The ground electrode includes a precious metal alloy portion containing: 50 weight % or more of a first component of one of Rh and Pt; less than 50 weight % of a second component of the other of Rh and Pt; and optionally a third component containing at least one of: Ni in an amount of less than 7 weight %; and Zr in an amount of less than 2 weight % the content of the third component being less than that of the second component.

12 Claims, 6 Drawing Sheets

U.S. PATENT DOCUMENTS

2005/0093415 A1* 5/2005 Suzuki ..... 313/141

FOREIGN PATENT DOCUMENTS

| | | |
|---|---|---|
| JP | 59-40482 | 3/1984 |
| JP | 59-160988 | 9/1984 |
| JP | 62-226592 | 10/1987 |
| JP | 5-74549 | 3/1993 |
| JP | 2001-118660 | 4/2001 |
| JP | 2002-343533 | 11/2002 |

* cited by examiner

SPARK PLUG HAVING GROUND ELECTRODE INCLUDING PRECIOUS METAL ALLOY PORTION CONTAINING FIRST, SECOND AND THIRD COMPONENTS

CROSS REFERENCE TO RELATED APPLICATIONS

This application claims benefit of U.S. Provisional Application No. 60/606,104 filed Sep. 1, 2004, incorporated herein by reference.

BACKGROUND OF THE INVENTION

1. Field of the Invention

The present invention relates to a spark plug.

2. Description of the Related Art

A spark plug has a cylindrical metal shell, in which a cylindrical insulator extends in the axial direction of the metal shell and is fixed to the inner side of the metal shell. Moreover, a center electrode extends in the axial direction of the metal shell such that its leading end protrudes from the insulator and its trailing end is fixed to the insulator. On the other hand, one end of the ground electrode is fixed to the metal shell and its other end portion forms a discharge gap with the leading end of the center electrode.

The ground electrode of a typical spark plug includes an electrode body made of a Ni alloy such as INCONEL 600 (product of Special Metals Corp., USA) or the like so as to exhibit excellent durability, and a tip made of a material resistant to spark discharge such as a Pt—Ir alloy welded to a portion of the ground electrode to form the discharge gap side of the electrode body. A spark plug having a ground electrode made of a Pt—Ir alloy as a whole is also known. Moreover, the spark plug, as disclosed in JP-A-5-74549, has a ground electrode composed of a core portion and a coating portion enveloping the core portion. The core portion is made of Ni, Cu or an alloy thereof, and the coating portion is made of a Pt—Ir alloy.

SUMMARY OF THE INVENTION

In the aforementioned spark plugs of the related art, however, it has been found that abnormal corrosion occurs in the ground electrode in the case where the spark plugs are used under extremely severe running condition. The abnormally corroded ground electrode is consumed at an accelerate rate. According to tests conducted by the present inventors, the consumption tendency is considerable when the spark plug is used in a hot and oxygen-containing atmosphere, such as that found in a gas engine for burning a gas fuel such as city gas (methane).

The present invention has been conceived in view of the aforementioned problems of the related art, and it is therefore an object of the present invention to provide a spark plug, having a ground electrode which is hardly abnormally corroded even when used under extremely severe running conditions.

The present inventors have extensively investigated solutions for solving the above-noted problems, and have completed the invention by finding that the cause of the abnormal corrosion is the Pt—Ir alloy composition of the related art ground electrode.

Specifically, it is known that the characteristics of Ir, as shown in FIG. 5, depend on the temperature and partial pressure of oxygen. As shown in FIG. 5 produces a volatile oxide such as $IrO_2$ in a hot and oxygen-rich atmosphere. If the spark plug of the related art having a ground electrode containing a Pt—Ir alloy is used at a temperature of about 1,000° C. or higher and in a rich atmosphere, the Ir of the Pt—Ir alloy is oxidized and volatilized as $IrO_2$. This forms a coat on the outer surface of the ground electrode, to thereby abnormally corrode the ground electrode.

The ground electrode thus corroded is acceleratedly consumed because its surface coat is easily peeled off.

On the other hand, it is known that the characteristics of Pt, as shown in FIG. 6, depend on the temperature and partial pressure of oxygen. It is also known that the characteristics of Rh, as shown in FIG. 7, depend on the temperature and the oxygen partial pressure. According to these characteristics, in a hot and oxygen rich atmosphere, Pt produces a volatile oxide of $PtO_2$. This temperature is relatively high, and Rh does not produce the volatile oxide.

According to one aspect the present invention provides a spark plug comprising: a cylindrical metal shell; a cylindrical insulator fixed to the metal shell; a center electrode having its leading end protruding from the leading end of the insulator and its trailing end fixed to the insulator, and a ground electrode having one end fixed to the metal shell and forming a discharge gap between itself and the center electrode. The ground electrode includes a precious metal alloy portion containing: a first component of one of Rh and Pt of not less than 50 weight %; a second component of the other of Rh and Pt of less than 50 weight %; and a third component less than the first component and the second component and made of at least one of Ni of less than 7 weight % and Zr of less than 2 weight %

In the invention, the precious metal alloy portion containing the first component of the highest content and the second component of the next highest content can inhibit the production of the volatile oxide in a hot and oxygen rich atmosphere. In the ground electrode having such a precious metal alloy portion, therefore, no abnormal corrosion occurs so that consumption can be inhibited. Moreover, the precious metal alloy portion preferably contains Ni in an amount of less than 7 weight % (but more than 0 weight %) as the third component, which amount is less than that of the first component and the second component, to thereby to improve the corrosion resistance and oxidation resistance of the precious metal alloy portion. The Ni content is preferably from 0.5 to 5 weight %.

Therefore, the spark plug of the invention can improve corrosion resistance and oxidation resistance, while inhibiting abnormal corrosion of the precious metal alloy portion even when used under extremely severe running conditions.

In the spark plug of the invention, moreover, the precious metal alloy portion preferably contains Zr in an amount of less than 2 weight % (but more than 0 weight %) in place of or in addition to the aforementioned Ni component. The Zr can inhibit grain growth of the metal crystals to be metallically bound, so that it can inhibit fatigue failure of the ground electrode. If the Zr content is excessive, however, it may exert another effect as an inclusion in the ground electrode. Therefore, Zr is preferably contained within a range of less than 2 weight %.

In the case that the precious metal alloy portion is substantially composed of Rh and Pt, the total of the weight % of the first component or one of Rh and Pt and the weight % of the second component of the other of Rh and Pt is 100 weight %. The term "substantially" allows for inevitable impurities. When the precious metal alloy portion contains another component, however, the total of the weight % of the first component and the weight % of the second component is less than 100 weight %. In this case, the first to third components can also be expressed by weight parts. Here, "weight parts" means a ratio which is expressed by taking the total weight of the precious metal alloy portion as a denominator and the weights of the individual first and second components as a numerator. If the precious metal alloy portion is substantially composed of Rh and Pt and if its total weight is equal to 100 parts, the weight parts are equal to weight %.

In the spark plug described in JP-A-2001-118660, the center electrode and the tip of the ground electrode are made of precious metal alloys containing Rh as the first component. However, the precious metal alloys of this spark plug do not contain Pt so that the effects of the invention cannot be sufficiently achieved. If the precious metal alloys are made of Rh as the first component, on the other hand, the Rh is so expensive that the cost for manufacturing the spark plug increases remarkably. By using Pt which is less expensive than the Rh, the invention realizes a reduction in cost in the manufacture of the spark plug while exhibiting the aforementioned effects.

In the spark plug of the invention, the precious metal alloy portion preferably contains substantially no Ir. This is because the oxidation and volatilization of the precious metal alloy portion can be inhibited in the hot and oxygen-rich atmosphere. In the spark plug described in JP-A-2001-118660, the precious metal alloy portion can contain Ir in an amount such that the effects of the invention are not achieved.

If the precious metal alloy portion contains Rh in an amount of more than 1 weight % or if the precious metal alloy portion contains Rh in an amount of less than 50 weight %, the spark plug can sufficiently exhibit the effects of the invention.

In addition to a construction in which the ground electrode is entirely made of the precious metal alloy portion, the ground electrode may have either a structure (1), in which a core portion made of a conductive material such as Ni, a Ni alloy, Cu or a Cu alloy is coated on its surface with a precious metal alloy portion, or a structure (2), in which the precious metal alloy portion is laser- or resistance-welded to the inner surface of the electrode body made of, e.g., a Ni alloy such as INCONEL 600 or the like.

The spark plug thus constructed according to the invention is well suited for use in a gas engine. This is because in a gas engine, the spark plug is subjected to a hot and oxygen-rich atmosphere.

BRIEF DESCRIPTION OF THE DRAWINGS

FIG. 3A is an enlarged perspective view of a ground electrode having a core portion fixed to a metal shell, and FIG. 3B is an enlarged perspective view of a ground electrode having a core portion spaced from the metal shell;

FIG. 4A is an explanatory view of a spark plug having a precious metal tip laser-welded to the ground electrode body, and FIG. 4B is an enlarged sectional view of that portion;

DETAILED DESCRIPTION OF THE INVENTION

An embodiment of the spark plug of the invention will next be described with reference to the accompanying drawings. However, the present invention shall not be construed as being limited thereto.

EXAMPLES

First, individual meta) powders of Pt, Ir, Rh, Zr and Ni, were mixed and molten in sample combinations 1 to 7, as shown in Table 1. Here, the numerals prefixed to the individual element symbols indicate weight %. Thus, precious metal alloys were obtained, as shown in Table 1.

TABLE 1

| | | Desktop Oxidation-Resistance Tests | | Engine Endurance |
|---|---|---|---|---|
| Sample No. | Components | 1,000 (° C.) | 1,200 (° C.) | Tests |
| 1 | 80Pt-20Ir | X | X | X |
| 2 | 100Rh | ○○ | Δ | — |
| 3 | 55Pt-44.5Rh-0.5Zr | ○○ | ○ | ○ |
| 4 | 79.5Pt-20Rh-0.5Ni | ○○ | ○ | — |
| 5 | 55Pt-40Rh-5Ni | ○ | ○ | ○ |
| 6 | 53Pt-40Rh-7Ni | ○ | Δ | Δ |
| 7 | 100Pt | ○ | Δ | Δ |

The precious metal alloys of the individual samples 1 to 7 thus obtained were formed to a size having a thickness of 1 mm and a width of 2.2 mm, and were prepared as ground electrodes having a general L-shape. Then, the sections of the ground electrodes were photographed by a SEM. Using the section photographs of the ground electrodes thus taken by the SEM as reference photographs, desktop oxidation-resistance tests and engine endurance tests were performed, as described below.

For the desktop oxidation-resistance tests, four ground electrodes each of samples 1 to 7 were prepared. The respective four ground electrodes of each sample were heated in an electric furnace in an air atmosphere at a temperature of 1,000° C. for one minute, and were then air-cooled for one minute. These operations were repeated for 200 hours, and sections of the ground electrodes of each of samples 1 to 7 were taken by the SEM. Next, similar desktop oxidation-resistance tests were performed by increasing the temperature of the electric furnace to 1,200 (° C.). The photographs of the individual sections thus taken by the SEM were used as comparison photographs.

By comparing the reference photographs and the individual comparison photographs, the thicknesses of the coats of volatile oxides formed on the surfaces of the ground electrodes were measured after the desktop oxidation-resistance tests. Thus, the thicknesses of the coats of the volatile oxides in the individual comparison photographs were averaged for each of the ground electrodes of the individual samples 1 to 7.

In the test results, an average of not more than 10 microns is designated by ○○; an average in the range of 10 to 50 microns is designated by ○; an average in the range of 50 to 100 microns is designated by Δ; and an average of not less than 100 microns is designated by X. The results are shown in Table 1.

Figure 1:
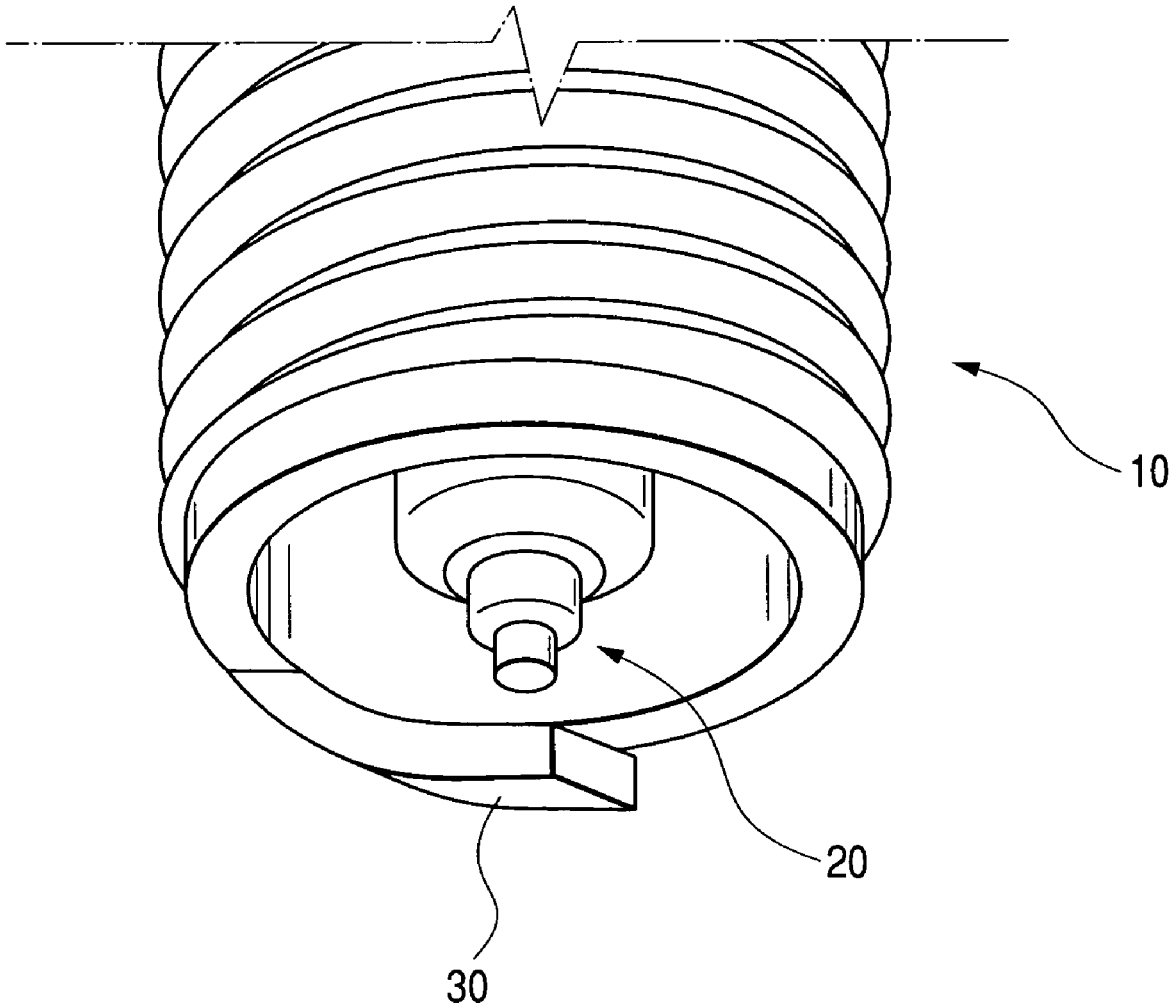
FIG. 1 is an enlarged perspective view of a ground electrode according to an embodiment of the invention.

On the other hand, a spark plug 10 was manufactured using the precious metal alloys of samples 1, 3 and 5 to 7 in a generally L-shaped ground electrode 30, as shown in FIG. 1. Four spark plugs 10 were manufactured for each of ground electrodes 30 of samples 1, 3 and 5 to 7.

Figure 2:
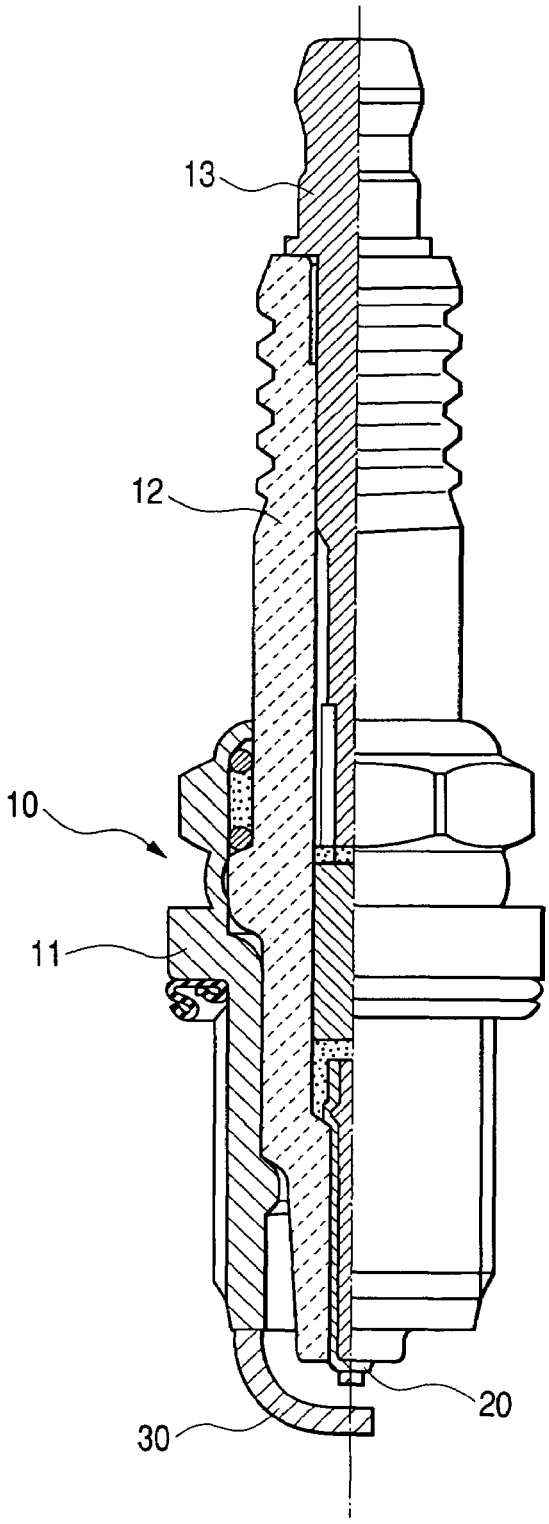
FIG. 2 is a partial sectional side elevation of a spark plug according to the embodiment.

The spark plug 10 of the embodiment is provided with a cylindrical metal shell 11, as shown in FIG. 2. In this metal shell 11, there is fixed a cylindrical insulator 12, which extends in the axial direction of the metal shell 11 such that its two ends protrude from the two ends of the metal shell 11. A center electrode 20 extends in the axial direction of the metal shell 11, which has its leading end protruding from the leading end of the insulator 12 and its trailing end fixed to a terminal 13 at its trailing end. One end of the ground electrode 30 is fixed to the metal shell 11, and the other end portion thereof forms a discharge gap between itself and center electrode 20. Center electrode 20 and ground electrode 30 are opposed to each other so as to form a discharge gap.

The engine endurance tests were performed by attaching the spark plug 10 thus manufactured to an engine (not-shown). The engine is run by burning a gas composed mainly of methane.

In the engine endurance tests, the engine was run continuously for 500 hours. After the engine was stopped, the individual sections of the ground electrodes 30 of samples 1, 3 and 5 to 7 were photographed by the SEM. The photographs of the individual sections thus taken by the SEM were used as comparison photographs.

As in the desktop oxidation-resistance tests, the reference photographs and the individual comparison photographs were compared to measure the thicknesses of the coats of the volatile oxides formed on the surfaces of the ground electrodes. Thus, the thicknesses of the coats of the volatile oxides of the individual comparison photographs were averaged for each of the ground electrodes 30 of the samples 1, 3 and 5 to 7.

The thicknesses of the coats of the volatile oxides were also evaluated as in the desktop oxidation-resistance tests. The results are shown in Table 1.

Evaluations the ground electrodes of samples 1 to 7, samples 2 to 7 in the desktop oxidation-resistance tests were evaluated as ○○ and ○ at 1,000 (° C.) and 1,200 (° C.).

As to the desktop oxidation-resistance tests at 1,000 (° C.) and 1,200 (° C.), it was confirmed that an oxide coat having a thickness of not less than 100 microns was formed on the surface of the ground electrodes of sample 1 and volatilized (by oxidation volatilization). On the surface of the ground electrodes of sample 2, a coat similar to the aforementioned one in the desktop oxidation-resistance test at 1,200 (° C.) was formed, and the coat more or less peeled off. When sample 2 was used as the ground electrode over a long period of time, the ground electrode suffered considerable grain growth. Such grain growth can result in fatigue failure. Moreover, a course coat was formed in the desktop oxidation-resistance test at 1,200 (° C.) on the surface of the ground electrode of sample 7. This condition may cause fatigue failure of the ground electrode of sample 7.

The ground electrode 30 of sample 3 contained 0.5 weight % of Zr, which inhibits granular growth of the metal crystals to which Zr is metallically bonded. As a result, it is possible to inhibit fatigue failure, as might otherwise be caused by granular oxidation of the ground electrode 30.

Of the individual ground electrodes 30 of samples 1, 3 and 5 to 7, on the other hand, samples 3 and 5 were evaluated "○" in the engine endurance tests.

In the engine endurance tests, the ground electrode 30 of the sample 6 suffered considerable spark consumption. It is considered that the consumption is caused by a Ni content of 7 weight % or more.

The precious metal alloy constituting the ground electrodes 30 of samples 3 to 5 was made of a first component of 50 weight % or more of one of Rh and Pt and a second component of 50 weight % or less of the other of Rh and Pt, which composition effectively inhibited the production of volatile oxides in the hot and oxygen rich atmosphere. Thus, abnormal corrosion and spark consumption are inhibited when the ground electrode 30 is composed entirely of the precious metal alloys of samples 3 to 5.

Even when the spark plug 10 of the present embodiment is used under extremely severe running conditions, hardly any abnormal corrosion of the ground electrode 30 is observed.

Since the precious metal alloys of samples 3 to 5 contain substantially no Ir, moreover, they can inhibit the oxidation volatilization of the precious metal alloys in a hot and oxygen-rich atmosphere.

Moreover, the precious metal alloys of samples 3 to 5 contained 1 weight % or more of Rh and 50 weight % or less of Rh so that they exhibited the aforementioned effects.

On the other band, the precious metal alloys of samples 4 to 6 contained Ni as a third component in an amount less than that of Pt or Rh so as to improve corrosion resistance and oxidation-resistance. For the precious metal alloy of the sample 6 containing Ni in an amount of 7 weight %, the evaluation of the desktop oxidation-resistance test at 1,200 (° C.) was Δ, and the engine endurance test evaluation was also Δ. It is therefore considered that Ni as the third component should be contained in an amount of less than 7 weight %.

Moreover, the precious metal alloy of sample 3 contained Zr so as to stabilize the metallic bond by inhibiting grain growth of the metal particles. This precious metal alloy also had good evaluations for the desktop oxidation-resistance and engine endurance tests.

The spark plug 10 using the precious metal alloys of samples 3 to 5 as the ground electrode 30 can be mounted on a gas engine (not shown). The ground electrode 30 of the spark plug 10 used in the gas engine is hardly oxidized or volatilized on its surface, and the coat is hardly formed on the outer surface of the ground electrode 30. As a result, the ground electrode 30 is hardly corroded.

The ground electrode 30 can be fabricated from the precious metal alloys of samples 3 to 5 as a whole, but can also be a part of a ground electrode 40, as described below.

Figure 3A:
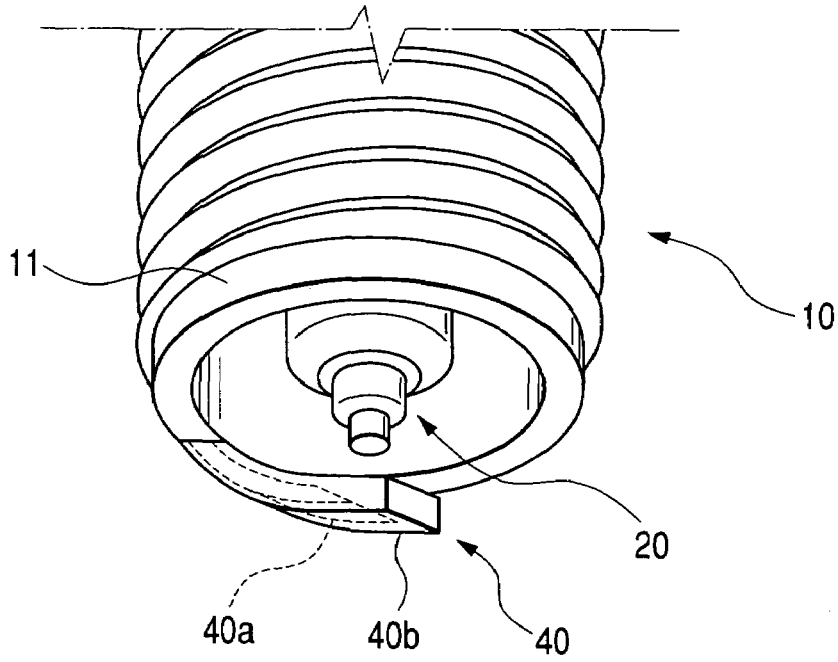
FIGS. 3A and 3B each shows an embodiment of the invention.
Figure 3B:
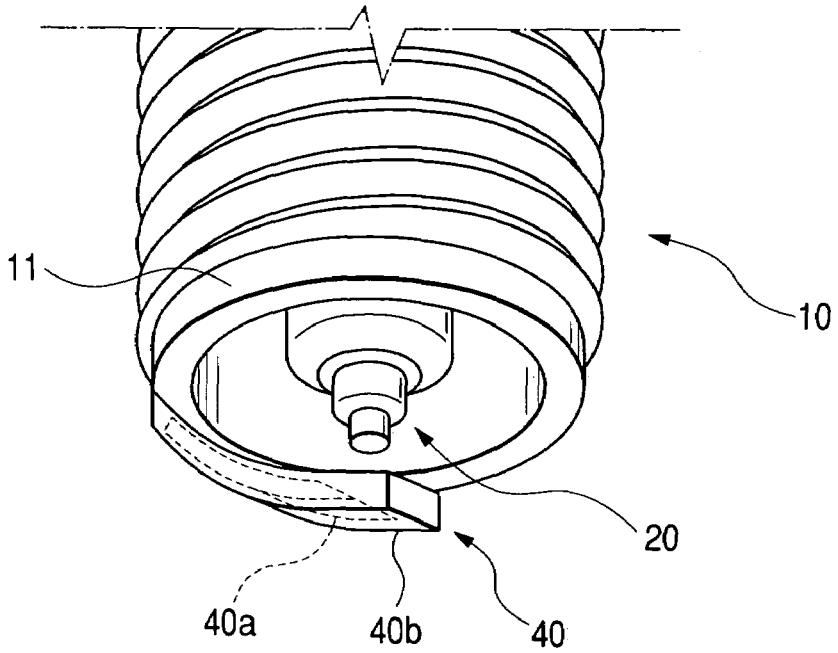

Specifically, in the spark plug 10 shown in FIG. 3A, the ground electrode 40 is constructed to include a core portion 40*a* fixed on the metal shell 11, and a coating portion (corresponding to a precious metal alloy portion) 40*b* enveloping the core portion 40*a*. In the spark plug 10 shown in FIG. 3B, on the other hand, the ground electrode 40 is constructed to include the core portion 40*a* spaced from the metal shell 11, and the coating portion 40*b* fixed on the metal shell 11. The individual core portions 40*a* are made of Ni, a Ni alloy, Cu or a Cu alloy and the like. The coating portions 40*b* are made of the precious metal alloys of the aforementioned samples 3 to 5. The spark plugs having such ground electrodes 40 can exhibit the aforementioned effects.

Figure 4A:
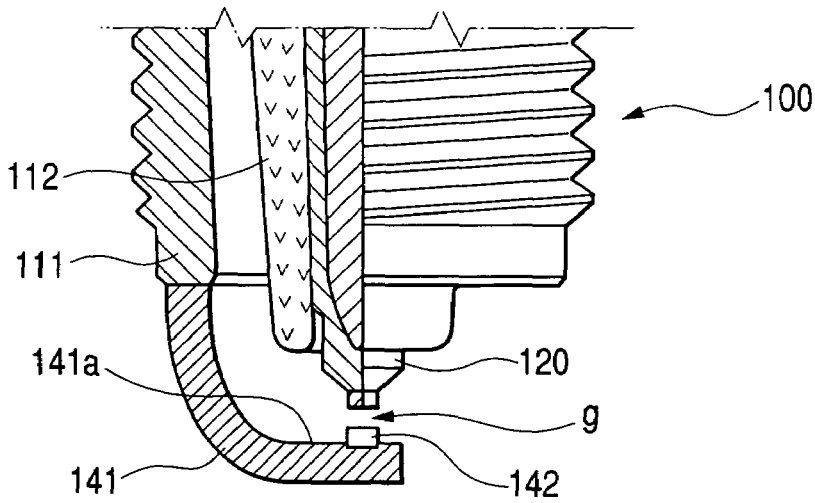
FIGS. 4A and 4B each shows an embodiment of the invention.
Figure 4B:
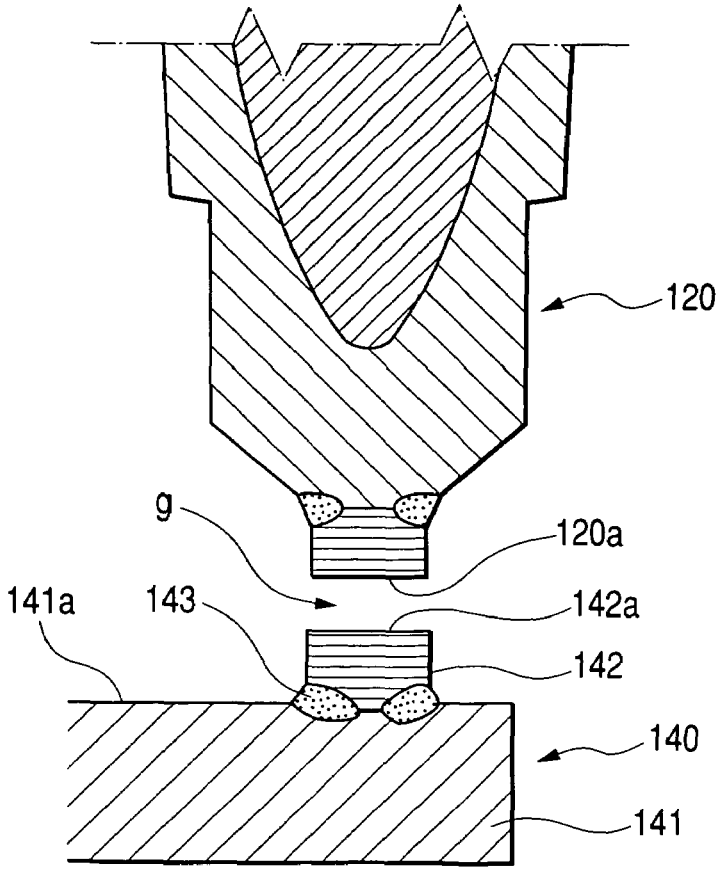
Figure 5:
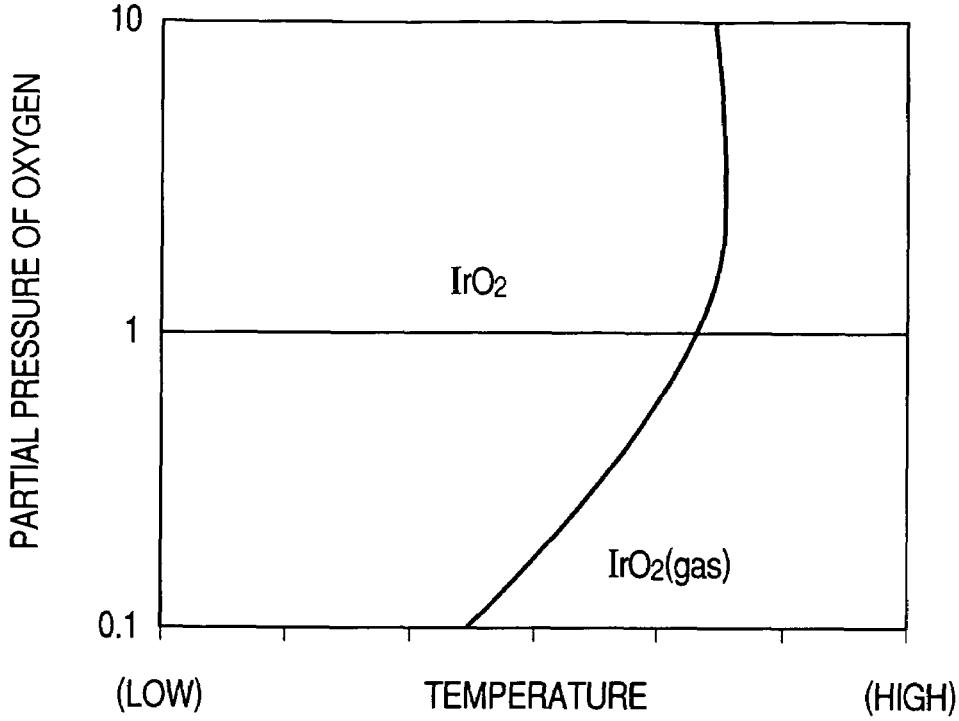
FIG. 5 is a graph showing the characteristics of Ir as a function of temperature and partial pressure of oxygen.
Figure 6:
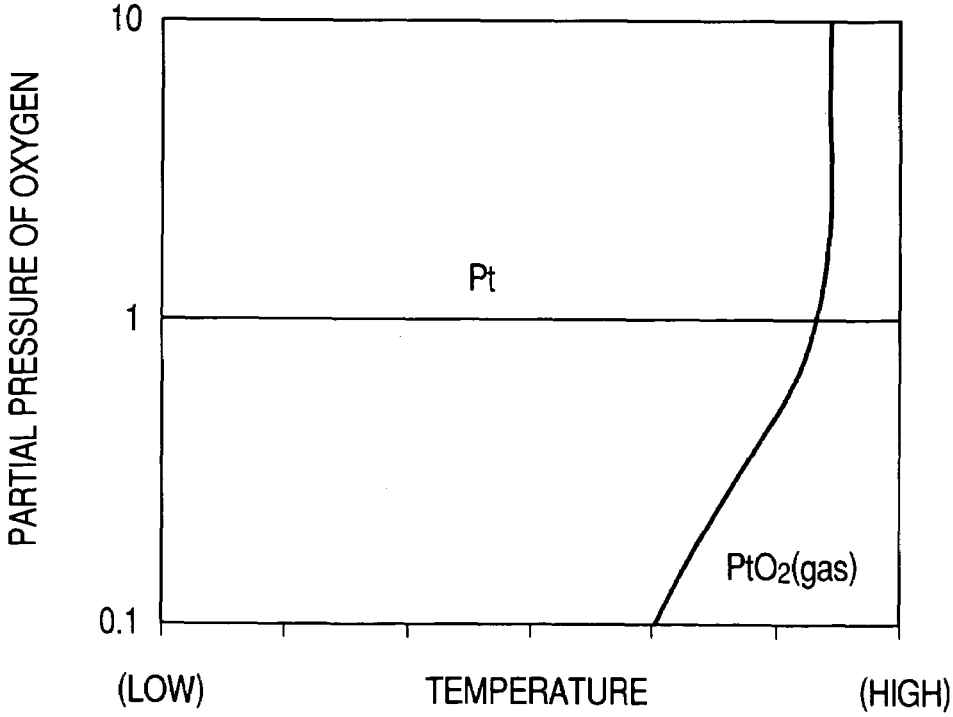
FIG. 6 is a graph showing the characteristics of Pt as a function of temperature and partial pressure of oxygen.
Figure 7:
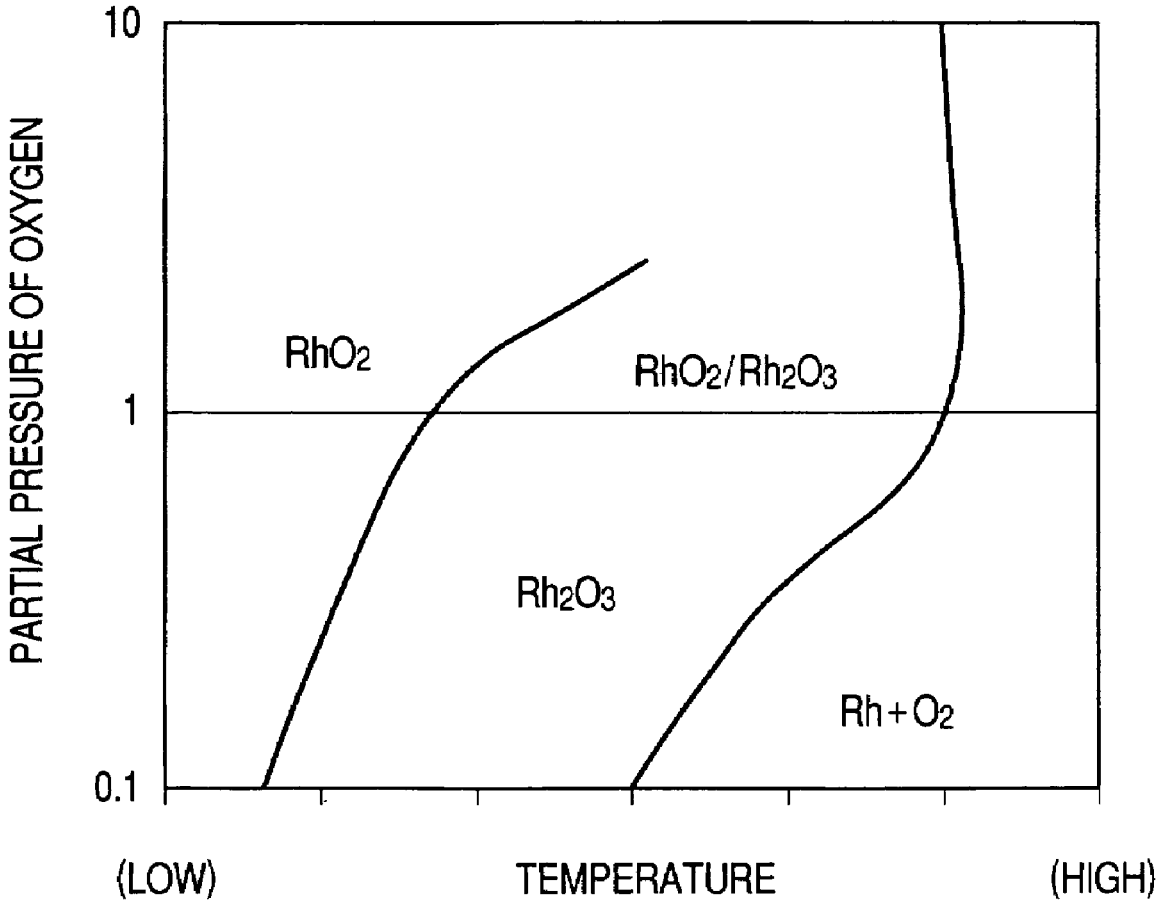
FIG. 7 is a graph showing the characteristics of Rh as a function of temperature and partial pressure of oxygen.

Furthermore, in a spark plug 100 shown in FIGS. 4A and 4B, a ground electrode 140 can be constructed to include a ground electrode body 141 made of an Ni alloy such as INCONEL 600 or the like, and a precious metal tip (corresponding to a precious metal alloy portion) 142. The ground electrode body 141 is fixed at its trailing end side to the metal shell 111 and is provided on the leading end side of an inner surface 141*a* with the precious metal tip 142, which is made of the precious metal alloys of the aforementioned samples 3 to 5. The precious metal tip 142 has a circular column shape, the root end portion of which is fixed to the inner surface 141*a* of the ground electrode body 141 via a molten bond 143 formed by laser welding. The leading end face 142*a* of precious metal tip 142 forms a discharge gap g between itself and the leading end face 120*a* of a center electrode 120. The leading end of center electrode 120 protrudes from insulator 112. In various preferred embodiments, the precious metal tip 142 is constructed so that it protrudes from the inner surface 141*a* of the ground electrode body 141 by 0.4 to 0.8 mm, the leading end face has a diameter ϕ of 0.5 to 1.5 mm, and the unmelted portion (the straight portion) protruding from a molten bond 143 has a length (height) of 0.25 to 0.45 mm. The spark plug having such a ground electrode 140 can also exhibit the aforementioned effects.

It should further be apparent to those skilled in the art that various changes in form and detail of the invention as shown and described above may be made. It is intended that such changes be include within the spirit and scope of the claims appended hereto.

This application is based on Japanese Patent application JP 2003-22798, filed Jan. 30, 2003, the entire content of which is hereby incorporated by reference, the same as if set forth at length.

What is claimed is:

1. A spark plug comprising:

a cylindrical metal shell;

a cylindrical insulator fixed in said metal shell;

a center electrode having its leading end protruding from a leading end of said insulator and its trailing end fixed to said insulator; and a ground electrode having one end fixed to said metal shell and forming a discharge gap between said ground electrode and said center electrode, wherein said ground electrode includes a precious metal alloy portion containing:

50 weight % or more of a first component of one of Rh and Pt;

less than 50 weight % of a second component of the other of Rh and Pt; and a third component including Zr in an amount of 0.5 weight % to less than 2 weight % and optionally Ni in an amount of 0.5 weight % to less than 7 weight %, the total content of said third component being less than that of said second component.

2. The spark plug as claimed in claim 1, wherein said precious metal alloy portion contains substantially no Ir.

3. The spark plug as claimed in claim 1, wherein said precious metal alloy portion contains more than 1 weight % of Rh.

4. The spark plug as claimed in claim 3, wherein said precious metal alloy portion contains less than 50 weight % of Rh.

5. The spark plug as claimed in claim 1, wherein said ground electrode further includes a core portion embedded in said precious metal alloy portion, and wherein said core portion contains at least one selected from the group consisting of Ni, a Ni alloy, Cu and a Cu alloy.

6. The spark plug as claimed in claim 1, wherein said ground electrode further includes a ground electrode body, and wherein said precious metal alloy portion is welded to an inner surface of said ground electrode body.

7. The spark plug as claimed in claim 6, wherein said precious metal alloy portion is formed by laser-welding a precious metal tip having a diameter of 0.5 to 1.5 mm to an inner surface of said ground electrode body, and an unmelted portion of said precious metal tip protrudes a distance within a range of 0.25 to 0.45 mm from a molten bond where said precious metal tip and said ground electrode body are melted together.

8. The spark plug as claimed in claim 7, wherein the precious metal tip protrudes from an inner surface of the ground electrode body by 0.4 to 0.8 mm.

9. The spark plug as claimed in claim 1, wherein said ground electrode is made of said precious metal alloy portion.

10. The spark plug as claimed in claim 1, adapted for mounting on a gas engine.

11. The spark plug as claimed in claim 1, wherein said precious metal alloy portion contains Ni in an amount of 0.5 weight % to less than 7 weight % and Zr in an amount of 0.5 weight % to less than 2 weight %.

12. The spark plug as claimed in claim 1, wherein said precious metal alloy portion contains Ni in an amount of 0.5 weight % to 5 weight % and Zr in an amount of 0.5 weight % to less than 2 weight %.

* * * * *